US008944434B2

(12) United States Patent
Yu

(10) Patent No.: US 8,944,434 B2
(45) Date of Patent: Feb. 3, 2015

(54) MELDING CARD GAMES WITH SOLVING COMPONENT

(75) Inventor: Brian M. Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 935 days.

(21) Appl. No.: 12/622,676

(22) Filed: Nov. 20, 2009

(65) Prior Publication Data

US 2010/0066021 A1 Mar. 18, 2010

Related U.S. Application Data

(62) Division of application No. 11/627,543, filed on Jan. 26, 2007, now abandoned.

(60) Provisional application No. 60/765,429, filed on Feb. 3, 2006.

(51) Int. Cl.

| | |
|---|---|
| ***A63F 1/00*** | (2006.01) |
| ***A63F 1/02*** | (2006.01) |
| *A63F 9/10* | (2006.01) |

(52) U.S. Cl.

CPC .... *A63F 1/02* (2013.01); *A63F 9/10* (2013.01)
USPC ..... 273/292; 273/293

(58) Field of Classification Search

USPC ..... 273/292, 293
See application file for complete search history.

(56) References Cited

U.S. PATENT DOCUMENTS

| | | | | |
|---|---|---|---|---|
| 3,734,510 A | | 5/1973 | Breslow | |
| 3,990,698 A | * | 11/1976 | Barlow | 273/292 |
| 4,009,884 A | | 3/1977 | Weigl | |
| 4,199,146 A | | 4/1980 | Dato | |
| 4,202,546 A | * | 5/1980 | Bromberg | 273/244.2 |
| 4,243,226 A | | 1/1981 | Kendall | |
| 4,315,627 A | * | 2/1982 | Schlegel et al. | 273/249 |
| 4,369,976 A | | 1/1983 | Chunn | |
| 4,566,698 A | * | 1/1986 | Sneden | 273/249 |
| 4,635,939 A | | 1/1987 | Makow | |
| 4,846,480 A | | 7/1989 | Oliver | |
| 4,915,393 A | | 4/1990 | Oliver | |
| 5,037,110 A | | 8/1991 | Haskel | |
| 5,054,775 A | * | 10/1991 | Banks et al. | 273/431 |
| 5,090,707 A | | 2/1992 | Patz | |

(Continued)

FOREIGN PATENT DOCUMENTS

| | | |
|---|---|---|
| FR | 2534143 A1 | 4/1984 |
| GB | 2230962 A | 7/1990 |

(Continued)

OTHER PUBLICATIONS www.ebay.com, printed Jan. 19, 2007, Item No. 220071448537, Entitled "Lie Detector Crime Solving Family Fun Game 1987 EX" (Category: Modern (1970-now) > Family, Listed In: Toys & Hobbies > Games > Board, Traditional Games > Other Board Games >), 5 pages.

(Continued)

*Primary Examiner* — Gene Kim
*Assistant Examiner* — Joseph B Baldori
(74) *Attorney, Agent, or Firm* — Edell, Shapiro & Finnan, LLC

(57) ABSTRACT

The present disclosure is directed to card games, and more particularly to card games in which players play to form certain card combinations or "melds," in order to collect information that in turn allows the players to solve a puzzle.

20 Claims, 13 Drawing Sheets

(56) References Cited

U.S. PATENT DOCUMENTS

| | | | | | |
|---|---|---|---|---|---|
| 5,100,154 | A | | 3/1992 | Mullins | |
| 5,106,100 | A | | 4/1992 | Yih | |
| 5,112,059 | A | | 5/1992 | Mundle et al. | |
| 5,180,306 | A | | 1/1993 | McInroy et al. | |
| 5,213,334 | A | | 5/1993 | Yih | |
| 5,374,067 | A | | 12/1994 | Jones | |
| 5,380,012 | A | | 1/1995 | Jones et al. | |
| 5,451,062 | A | | 9/1995 | Malone | |
| 5,692,750 | A | | 12/1997 | Poole | |
| 5,711,526 | A | | 1/1998 | Van Hollebeke | |
| 5,772,212 | A | | 6/1998 | Hagedorn | |
| 5,810,361 | A | | 9/1998 | Kadlic | |
| 5,816,576 | A | * | 10/1998 | Aramapakul et al. | 273/292 |
| 5,863,040 | A | | 1/1999 | Van Gass | |
| 5,863,043 | A | | 1/1999 | Bitner | |
| 5,887,873 | A | | 3/1999 | Freeman | |
| 5,951,013 | A | | 9/1999 | Campanella | |
| 6,003,869 | A | | 12/1999 | Kuo | |
| 6,142,475 | A | | 11/2000 | Hennessey | |
| 6,193,235 | B1 | | 2/2001 | Vancura et al. | |
| 6,247,697 | B1 | | 6/2001 | Jewett | |
| 6,254,099 | B1 | | 7/2001 | Pederson | |
| 6,267,377 | B1 | | 7/2001 | Griggs | |
| 6,332,615 | B1 | | 12/2001 | Watanabe | |
| 6,412,779 | B1 | | 7/2002 | Kenney | |
| 6,454,265 | B1 | | 9/2002 | Elliott et al. | |
| 6,588,756 | B1 | | 7/2003 | Hughes | |
| 6,651,984 | B1 | | 11/2003 | Luken | |
| 6,843,477 | B2 | | 1/2005 | Simmons, Jr. | |
| 6,905,122 | B2 | * | 6/2005 | Weigl et al. | 273/292 |
| 7,621,534 | B2 | | 11/2009 | Hui | |
| 2001/0035612 | A1 | | 11/2001 | Loder | |
| 2003/0031990 | A1 | * | 2/2003 | Venegas, Jr. | 434/188 |
| 2004/0036220 | A1 | | 2/2004 | Tanaka | |
| 2004/0090007 | A1 | | 5/2004 | Simmons, Jr. | |
| 2004/0164493 | A1 | | 8/2004 | Hyduk | |
| 2005/0189716 | A1 | | 9/2005 | Yu | |
| 2005/0275167 | A1 | | 12/2005 | Wilson | |
| 2006/0038345 | A1 | * | 2/2006 | Barthold | 273/273 |
| 2007/0102880 | A1 | * | 5/2007 | Kellett et al. | 273/242 |

FOREIGN PATENT DOCUMENTS

| | | | |
|---|---|---|---|
| WO | 2004103494 | A2 | 12/2004 |
| WO | 2005074581 | A2 | 8/2005 |

OTHER PUBLICATIONS

First Office Action for Chinese Patent Application No. 200710001882.3 dated Aug. 21, 2009, 4 pages.

Examination Report for UK Patent Application No. GB0701941.7 dated Apr. 30, 2010, 2 pages.

Search Report and Written Opinion for FR Patent Application No. 0700752 dated Feb. 18, 2009, 4 pages.

* cited by examiner

MELDING CARD GAMES WITH SOLVING COMPONENT

CROSS-REFERENCE TO RELATED APPLICATIONS

This patent application is a divisional of U.S. Non-Provisional patent application Ser. No. 11/627,543, entitled "Melding Card Games with Solving Component," filed Jan. 26, 2007, which is based upon and claims priority under 35 U.S.C. §119(e) to U.S. Provisional Patent Application No. 60/765,429, entitled "Melding Card Games with Solving Component," and filed Feb. 3, 2006, the disclosures of each of those applications are incorporated herein by reference in their entirety for all purposes.

SUMMARY OF THE INVENTION

The present disclosure is directed to card games, and more particularly to card games in which players play to form certain card combinations or "melds," in order to collect information that in turn allows the players to solve a puzzle.

For example, some embodiments may include various playing cards, information cards with pieces of information relating to a possible solution, and a solution card that indicates the possible solutions. In an exemplary method of game play, a predetermined number of information cards may randomly be selected prior to game play, the information on the selected cards collectively indicating one of the several possible solutions. During game play, forming a meld of playing cards may allow a player to attempt to discover the piece of information on one of the information cards, for example by attempting to satisfy a requirement associated with a particular piece of information. In such a method, the goal of a player who has succeeded in discovering enough pieces of information may be to correctly determine the solution based on the discovered information in order to win the game.

Traditional card games in which players attempt to form melds include Rummy and variants such as Gin Rummy, Canasta, Five Hundred, Go Fish, and Old Maid. Specialized decks have been developed for use with some card games, such as Mille Bornes® (Parker Brothers, Inc.), Uno® (Mattel, Inc.), and the melding card game disclosed in U.S. Pat. No. 6,247,697. Some specialized decks include cards that have certain effects on game play. For example, the game of Uno includes cards that instruct a player to perform an action such as drawing a number of additional cards.

Other examples of card decks and/or games in which objects or cards are matched to create sets or melds include the games and card decks disclosed in U.S. Pat. Nos. 3,734,510, 3,990,698, 4,243,226, 4,369,976, 4,846,480, 4,915,393, 5,037,110, 5,106,100, 5,213,334, 5,374,067, 5,380,012, 5,451,062, 5,711,526, 5,772,212, 5,810,361, 5,816,576, 5,863,043, 5,887,873, 6,142,475, 6,332,615, 6,454,265, 6,588,756, and UK Patent Application GB 2,230,962A.

The disclosures of all of the aforementioned references are incorporated herein by reference in their entirety for all purposes.

The card games of the present disclosure may be understood more readily after a consideration of the drawings and the Detailed Description.

DETAILED DESCRIPTION

Figure 1:
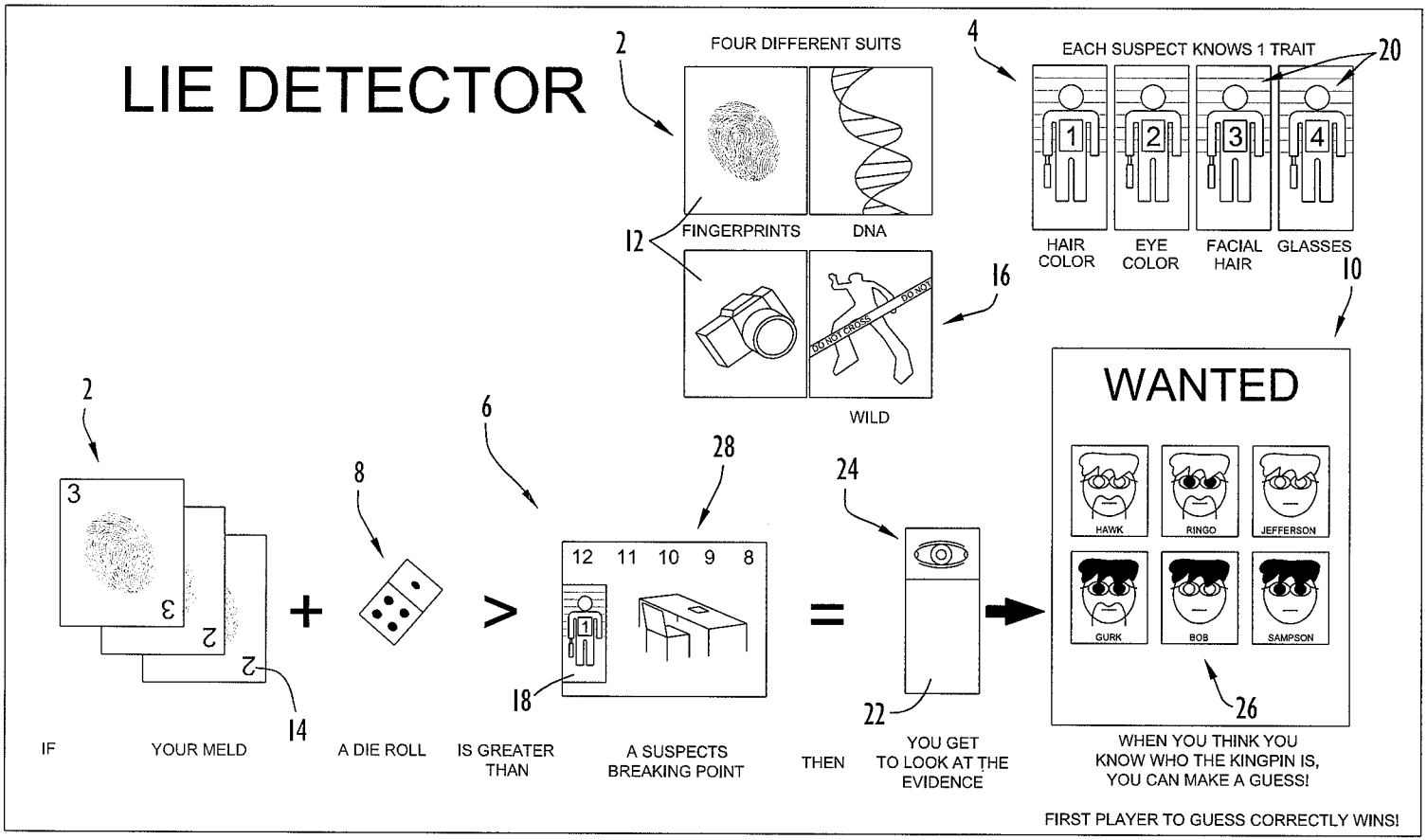
FIG. 1 is a product concept presentation sheet showing various exemplary game components including playing cards, information cards, an exemplary requirement card, a die, and a solution card.

Referring to FIG. 1, components of a card game according to one embodiment of the present disclosure are shown to include several different types of playing cards 2, information cards 4, an exemplary requirement card 6, a die 8, and a solution card 10.

The exemplary playing cards shown may each have an obverse face including suit indicia 12 indicating one of several suits or categories of cards, and may also include card value indicia 14 indicating a numerical or other value of the card. Suit indicia 12 may be of any appropriate form adapted to distinguish cards of one suit from cards of another, and may thus include one or more indicia such as color, symbols, and so forth.

The suit indicia 12, as well as other features or components of the game apparatus, may reflect a theme or backstory associated with the game. For example, a commercial embodiment of the game illustrated in the figures is called "Lie Detector," and the various game components feature game indicia and other decorative indicia resembling items, settings, and characters consistent with a "criminal investigation" theme, such as fingerprints, cameras, interrogation rooms, suspects, criminals, investigators, and other similar devices, symbols, and indicia. Moreover, a fanciful lexicon consistent with this theme is used in a set of instructions and rules that accompany this embodiment of the game. However, embodiments consistent with the game concepts and components discussed herein may include game components and/or rules that reflect any theme or combination of themes, or no theme, with any suitable indicia.

Thus, for example, the illustrated playing cards 2 are shown to include both a color (such as blue, green, etc.) and a symbol (such as a fingerprint, a camera, etc.) to distinguish the different suits. One suit is indicated to be a "wild" suit, cards of which may be used in some aspects of game play to substitute for other suited cards. Wild cards 16 include indicia designating the card as a wild card (shown in FIG. 1 as a chalk outline of a body).

Card value indicia 14 on the obverse face of some playing cards 2 may be indicated, for example, by a number, as shown on the exemplary melding cards of FIG. 1. As explained in more detail below, when a player forms a meld of cards during one method of game play, the values may be used to determine if a piece of information may be revealed to the player.

Figure 2:
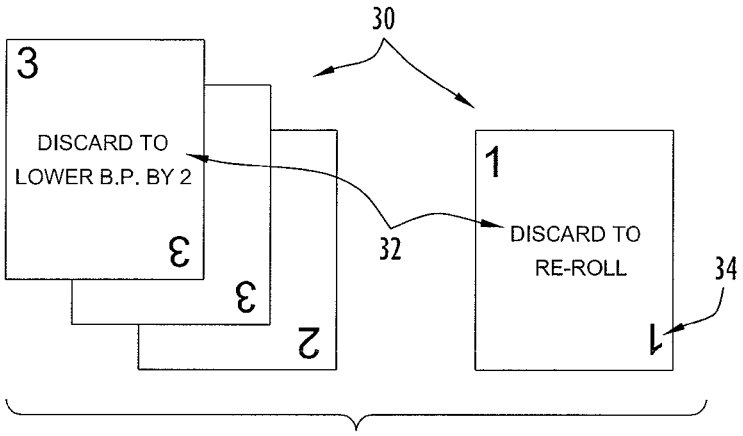
FIG. 2 is a photograph of prototype playing cards suitable for use with the games of the present disclosure, which include instruction indicia.

In some embodiments of the game, the obverse side of some or all of the playing cards may include other indicia, such as instructions to take a certain game action, for example if the playing card is discarded or played. FIG. 2 shows a prototype embodiment of a variant of the game that includes some playing cards or melding cards 30 with such instructional indicia 32.

The reverse face of the playing cards (not shown) may include generic indicia, trade dress indicia, and/or other indicia, or may be left blank, such that the playing cards are indistinguishable when viewed from the reverse face.

Referring again to FIG. 1, the exemplary embodiment of the card game also includes several information cards 4. As mentioned above, the information indicated by the information cards may allow the players of the game to solve a problem or puzzle as part of game play. Consistent with the "criminal investigation" theme of the described embodiments, the puzzle may be determining which of several criminals or "kingpins" perpetrated a crime.

Each information card 4 is shown to include an obverse side 18 with category and other indicia 20, and a reverse side 22 with information indicia 24. The category indicia 20 indicates the type of information indicated on the reverse side 22. The information, as well as the categories, may reflect a game theme, as explained above. For example, in the exemplary embodiment shown, the categories of information may indicate suspects involved in the crime to be solved, each of which holds a piece of information about the criminal or "kingpin" behind the crime. The information may thus correspond to physical traits of the criminal, such as "eye color," "hair color," and so forth. The information indicia 24 on the reverse side 22 of an information card 4 may indicate one of several possibilities within the category indicated on the obverse side 18. For example, an "eye color" information card may indicate information indicia such as "blue eyes," or some other eye color.

The illustrated embodiment described herein includes four categories of information, with two possibilities for each category. Thus, there are eight different information cards 4, two of each category, as follows:

| Category | Information |
|---|---|
| eye color | blue eyes<br>brown eyes |
| hair color | black hair<br>blond hair |

-continued

| Category | Information |
|---|---|
| facial hair | clean-shaven<br>moustache |
| glasses | no glasses<br>glasses |

In one method of game play, one of each category of information card may be selected at random at the beginning of the game. The information on the selected information cards describes one of $2^4$, or 16, possible combinations of the four categories or traits. Each combination may thus correspond to one of 16 different "kingpins." Players of the game may be allowed to discover the information indicated on one or more information cards 4 during game play, and attempt to determine the solution to the problem or puzzle, by deducing the identity of the kingpin.

Figure 3:
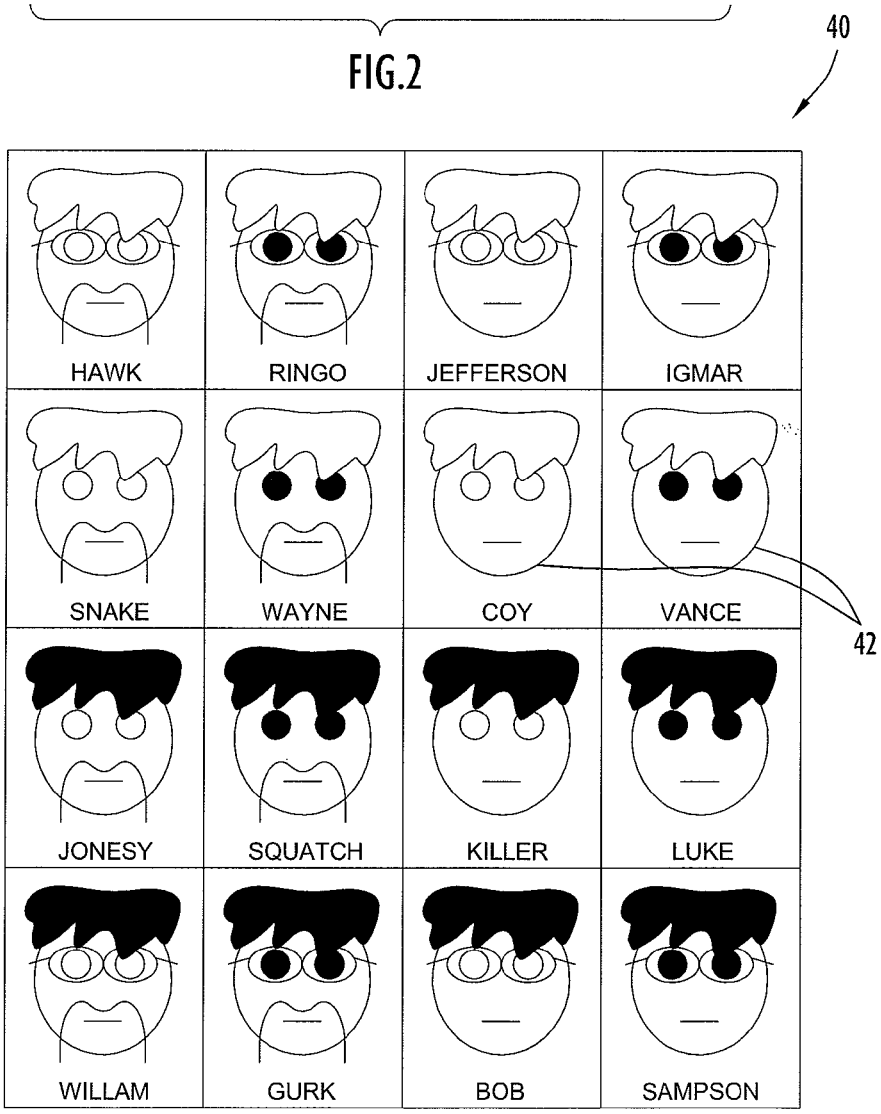
FIG. 3 is photograph of an exemplary embodiment of a solution card suitable for use with the games of the present disclosure.

Thus, the exemplary embodiment may also include a solution card 10, which includes solution indicia 26 indicating the different combinations of categories or traits. The solution card 10 indicated in FIG. 1 is an illustrative prototype, but FIG. 3 shows another exemplary solution card 40 consistent with the categories and information listed above, having 16 different solution indicia 42 as illustrations of different kingpins with the traits conveyed by the information on the information cards 4. For example, each kingpin is illustrated to have either blond or black hair, either blue or brown eyes, and so forth. Each kingpin is also shown to be indicated by a name, which may serve as a convenient label to refer to the combination of traits associated with the kingpin. Thus, in the illustrated embodiment, the solution to the puzzle may be the name of the kingpin having the combination of traits indicated on the selected information cards 4.

Thus, it can be seen that other embodiments of the game may incorporate a different number of categories of information, a different number of possibilities within each category, a different number of solutions, and so forth, as appropriate to achieve a desired level of difficulty for the game players.

Referring again to FIG. 1, an exemplary requirement card 6 is shown to include requirement indicia 28, shown as a series of numbers printed across the top edge of the card. As explained in more detail below, the requirement indicia 28 may indicate a requirement that must be satisfied, during game play, for a player to be allowed to discover the information on the reverse side 22 of an information card 4 associated with the requirement card 6. For example, in an exemplary method of game play suitable for use with the illustrated embodiment, pre-game setup may include placing each randomly selected information card 4, obverse-side up, on a requirement card 6, to indicate the requirement to be satisfied in order for a player to "discover" the information on the information card 4.

For example, the information card 4 on the requirement card 6 in FIG. 1 is associated with the requirement indicia 28 indicated by the number "12," since the information card 4 is shown to be placed on the requirement card 6 in visual alignment with the requirement indicia 28 indicating the number 12. In other embodiments, such as the exemplary prototype information cards shown in FIGS. 4-6, each of which includes a small notch in its top edge, the requirement indicia 28 may be indicated by the number aligned with the notch.

As explained in greater detail below, in some aspects of game play suitable for use with the illustrated embodiment, whether a player may discover the information on an information card may relate to the meld of cards formed by the player and the requirement indicia 28 associated with the information card 4. For example, when a meld of cards is formed, a player may add the sum of the values of the playing cards 2 in the meld and compare the resulting value to the number indicated by the requirement indicia 28 associated with a chosen information card 4. Optionally, the player may also roll one or more dice to generate an additional value to add to the sum.

FIG. 1 illustrates this concept by showing an exemplary meld of playing cards 2 with card values 3-2-2. Adding these card values together yields the total 7, which may then be added to the number indicated by a roll of a die 8. The sum of the card values and the die roll may then be compared with the requirement indicia 28, which in this example is the number "12."

According to an exemplary set of rules, if the sum exceeds the value on the requirement card 6, the requirement is deemed to be satisfied, and the player may look at the information on the reverse side 22 of the information card 4.

Consistent with the aforementioned theme of the game, the requirement card 6 may thus include decorative indicia indicating an interrogation room, in which the suspect (on an information card) is interrogated. The suspect's "breaking point" (the requirement to be satisfied) may be indicated by one of the requirement indicia 28, for example the number immediately above the information card 4 when placed on the requirement card 6. The value of the player's meld, plus the number indicated by a roll of the die, may represent the player's attempt to interrogate the suspect. If successful, the suspect is "broken," and divulges information about the kingpin—and the player may accordingly be allowed to look at the information on the reverse side 22 of the information card 4.

Further, in some aspects of game play, an information card 50 may be moved, during game play, relative to its associated requirement card 60, such as to change the requirement that must be satisfied by a player attempting to discover the information on the information card 50. For example, in FIGS. 5 and 6, the information card 50 is moved to indicate that the requirement indicia 62 is changed from the number "20" to the number "19." This may be done during game play, for example, after a player attempts to discover the information on the information card 50.

Figure 4:
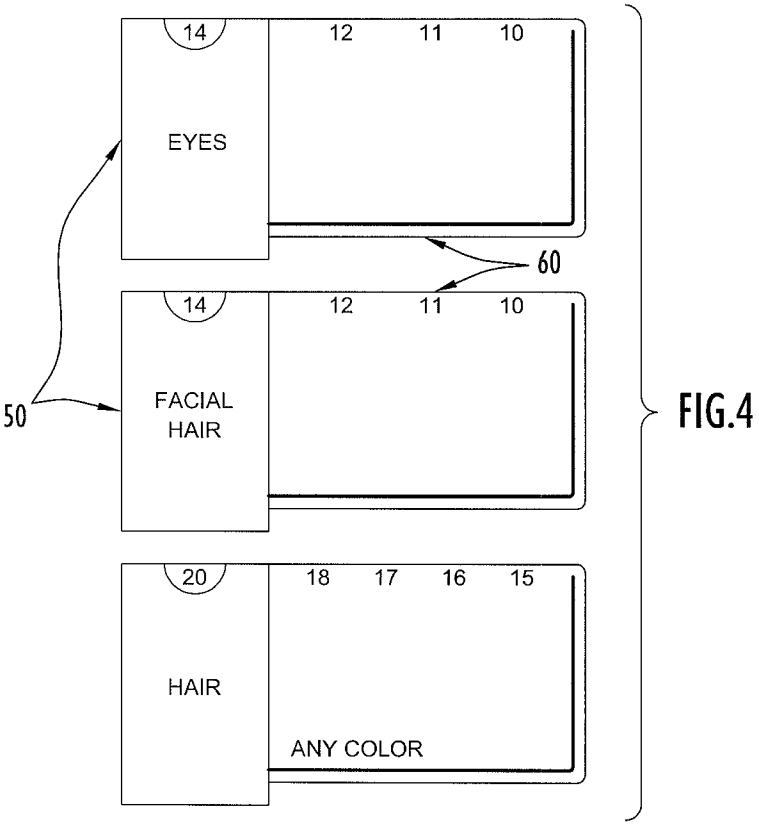
FIG. 4 is a photograph of prototype information cards and requirement cards suitable for use with the games of the present disclosure.

Moreover, in some embodiments, the various requirement cards 60 may be associated with one or more categories of information cards 50. The requirement cards 60 of FIG. 4 are shown to include colored borders, each of which may indicate a predetermined association with information cards 50 of a particular category.

Variations in the aforementioned game components and concepts are considered to be within the scope of the present disclosure. For example, although the requirement indicia and the card value indicia have been described in terms of numbers or numerical values, any such indicia that is adapted to represent a requirement or condition to be satisfied, and a characteristic associated with the card that relates to the requirement or condition, may be used. For example, each card value may be indicated by any appropriate symbol or set of symbols; an alternate embodiment may include playing cards that each include colored shapes and requirement cards with requirement indicia indicated by a set of colored shapes. All of such variations are considered to be within the scope of this disclosure.

An exemplary, non-limiting method of game play utilizing the components and concepts discussed above is outlined in the paragraphs below. Games may be played by two or more players, each of which is dealt a predetermined number of cards and plays them on a playing surface according to a set of rules. As described in greater detail below, when a meld is formed, a player may attempt to discover the information indicated by an information card 4 in an attempt to solve the crime by identifying the kingpin corresponding to the information on the information cards 4.

An exemplary method of game play for the embodiments shown in the figures provides that, prior to game play, all of the information cards 4 are shuffled, and one of each category is randomly selected. Each information card 4 is placed, showing the obverse side 18, on a requirement card 6, either at random or according to a predetermined arrangement, to indicate one of the requirement indicia 28 on the requirement card 6. For example, each information card 4 may be placed to indicate the highest numerical value on the requirement card 6. The playing cards 2 are shuffled together, a predetermined number is dealt to each player, and the remainder are placed face-down (that is, showing the reverse side 22) to form a draw pile. The top card is turned up (that is, showing the obverse side 18) to form a discard pile.

Any suitable method may be used to choose which player plays first, after which players take alternating turns.

During a turn, a player draws a predetermined number of cards from either the draw pile and/or the discard pile, and attempts to "meld" or form certain card combinations called "melds," by laying a meld of playing cards 2 on the playing surface. Traditionally, melds include sequences of consecutively ranked cards in a particular suit, a group of cards of the same rank in different suits, and so forth. However, a set of rules for the game may indicate any desired combination or combinations of cards that may qualify as a "meld." For example, according to an exemplary set of rules suitable for use with the illustrated embodiment and method, a meld may consist of one of the following card combinations:

three cards of the same suit;

two cards of the same suit plus one wild card; or two wild cards plus any other card.

When a meld is formed, the player places the melded playing cards 2 on the playing surface and chooses which "suspect" the player will attempt to "break." In other words, the player chooses an information card 4, and attempts to discover the information indicated on the chosen card. To do this, the player notes the requirement indicia 28 on the requirement card 6 indicated by the information card 4 and determines whether he has satisfied the requirement. For example, he may roll a die, add the number indicated on the die to the sum of the card values of the melded playing cards, and compare the total to the numerical value indicated by the requirement indicia 28 on the requirement card 6.

According to an exemplary set of rules, if the total exceeds the suspect's "breaking point" indicated by the requirement indicia 28, the player may look at the information on the reverse side 22 of the information card 4. The player then notes the information, and replaces the information card 4 on the requirement card 6. In some methods, the information card 4 may then be moved on the requirement card 6 to indicate a lower value on the requirement card 6, for example to indicate that once the suspect has been "broken," subsequent attempts by other players to discover the suspect's information will be less difficult.

If the player's total does not exceed the suspect's "breaking point," play may pass to the next player. In some methods, the information card 4 may then be moved on the requirement card 6 to indicate a lower value on the requirement card 6, for example to indicate that a suspect may be easier to "break" if repeated attempts have been made. Some methods may include moving the information card 4 on a requirement card 6 to a greater or lesser extent, depending on whether a player succeeds in "breaking" the suspect.

A player may be given an opportunity, for example before play passes to another player, to attempt to guess the identity of the kingpin, based on the information the player has discovered during the course of the game. In an exemplary set of rules, an incorrect guess may eliminate the player from the game, but a correct guess wins the game. So as not to spoil the fun for the remaining players, the guessing player may determine if his guess is correct by privately looking at all of the information on the information cards, revealing them to show that his guess is correct, or replacing them (without showing them to the other players) if his guess is not correct. In the latter case, the remaining players may proceed until someone correctly guesses the kingpin.

Figure 7:
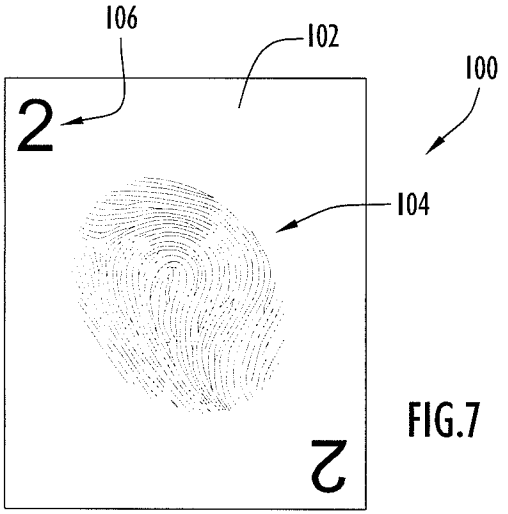

Referring to FIG. 7, an exemplary embodiment of a playing card of FIG. 1 is illustrated. In this embodiment, the playing card 100 has a side 102 that includes a symbol 104 that distinguishes the suit of the playing card 100. Playing card 100 includes card value indicia 106, which in this embodiment is the number 2.

Figure 8:
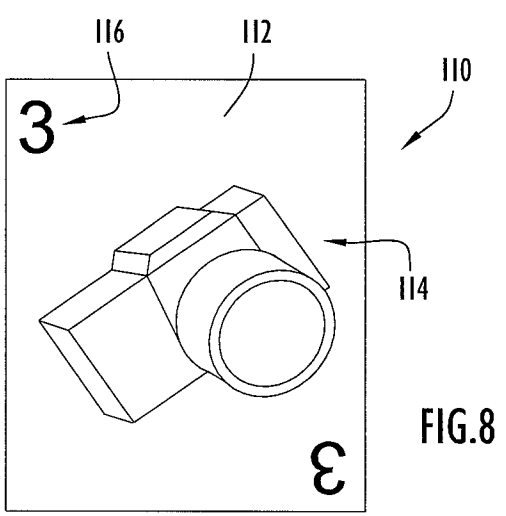
FIGS. 7-10 are alternative embodiments of playing cards according to the present invention.
Figure 10:
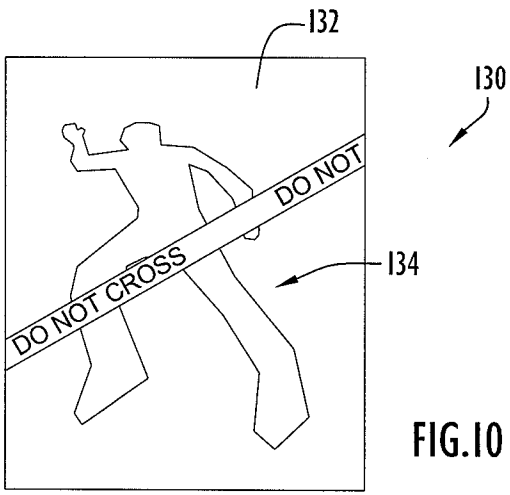
Figure 9:
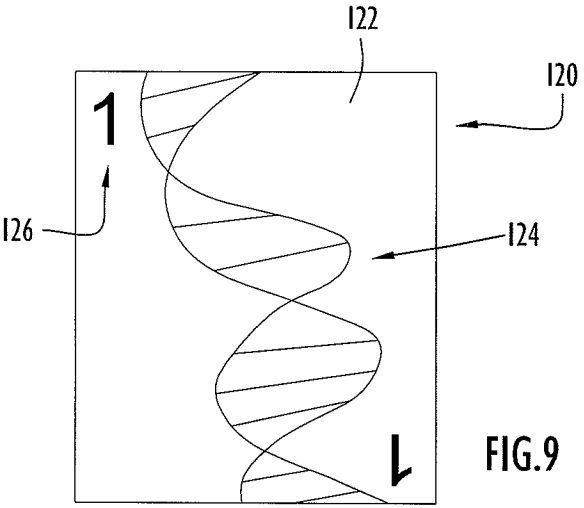

Other embodiments of playing cards of FIG. 1 are illustrated in FIGS. 8-10. As illustrated in FIG. 8, the playing card 110 has a side 112 that includes a symbol 114 and a card value indicia 116, which in this embodiment is the number 3. In FIG. 9, the playing card 120 has a side 122 that includes a symbol 124 and a card value indicia 126. In FIG. 10, the playing card 130 has a side 132 that includes a symbol 134, which in this embodiment represents a "wild" suit.

Figure 5:
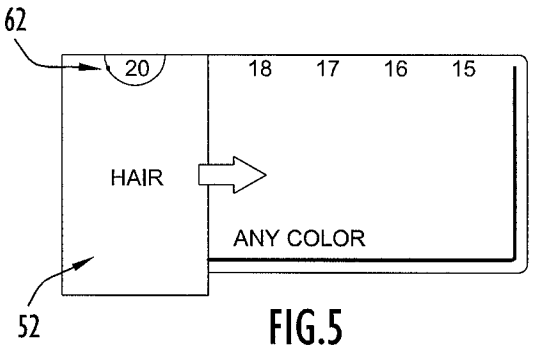
FIGS. 5 and 6 are photographs of one of the information cards and one of the requirement cards of FIG. 4, showing an exemplary method of moving the information card relative to the requirement card.
Figure 6:
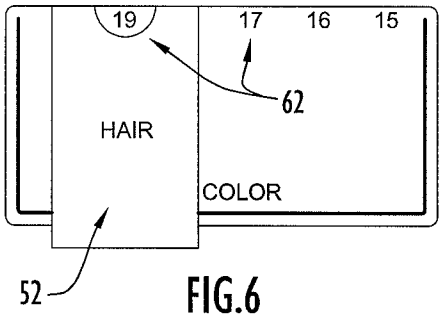
Figure 11:
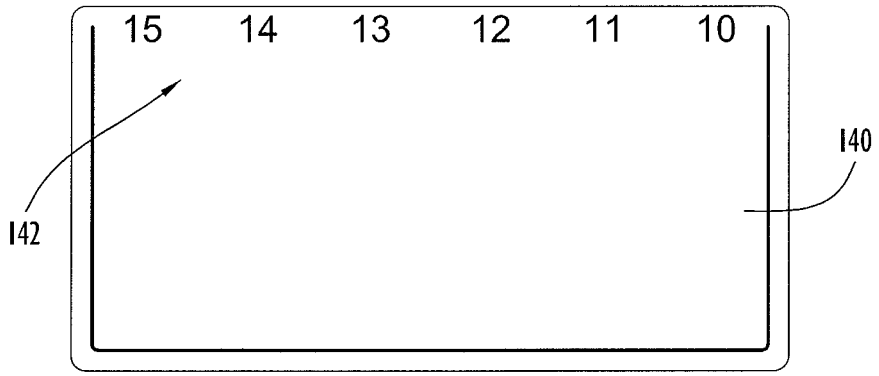
FIGS. 11 and 12 are alternative embodiments of requirement cards according to the present invention.

Referring to FIG. 11, an embodiment of a requirement card of FIGS. 4-6 is illustrated. In this embodiment, the requirement card 140 includes requirement indicia 142, which is shown as a series of numbers printed across the top edge of the card 140. As previously described, the requirement indicia may indicate a requirement that must be satisfied, during game play, for a player to be allowed to discover the information on an information card associated with the requirement card.

Figure 12:
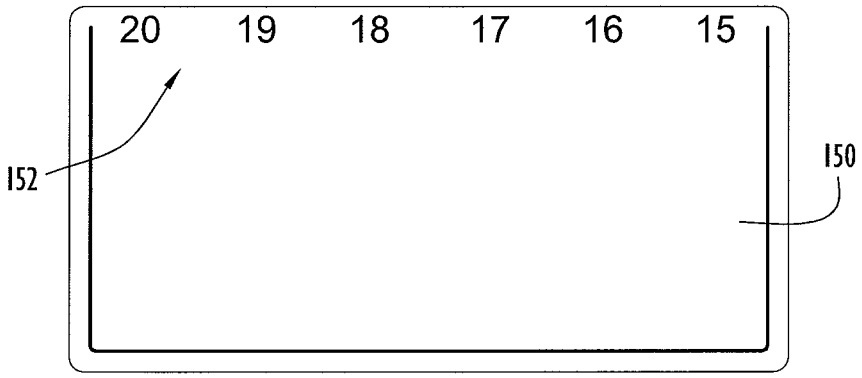

Referring to FIG. 12, an alternative embodiment of a requirement card is illustrated. In this embodiment, the requirement card 150 includes requirement indicia 152. The requirement indicia 152 of requirement card 150 can be different than that of requirement indicia 142 of requirement card 140.

Figure 13:
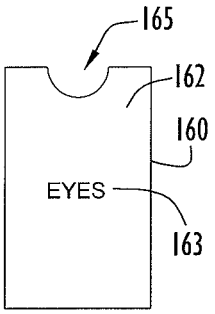
FIG. 13 is a front view of an embodiment of an information card according to the present invention.
Figure 14:
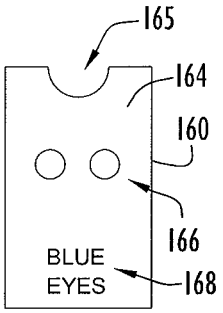
FIG. 14 is a rear view of the information card illustrated in FIG. 13.

Referring to FIGS. 13 and 14, an embodiment of an information card of FIG. 1 is illustrated. In this embodiment, the information card 160 includes an obverse side 162 with category indicia 163, which in this example, is "eyes," and a reverse side 164 with information indicia 166 and 168, which in this example, relate to "blue eyes." Information card 160 includes a small notch 165 in its top edge.

Figure 15:
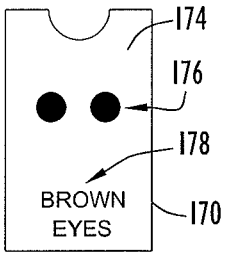
FIGS. 15-21 are rear views of alternative embodiments of information cards according to the present invention.
Figure 16:
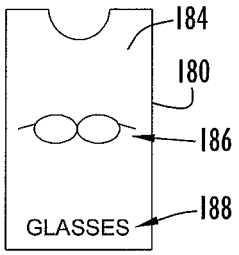
Figure 17:
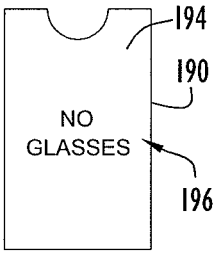
Figure 18:
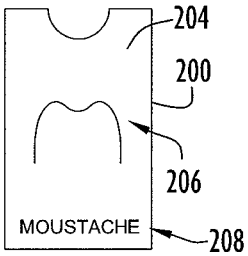
Figure 19:
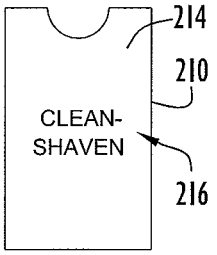
Figure 20:
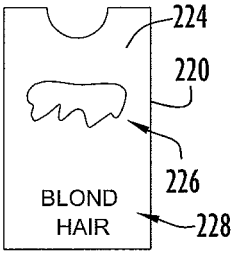
Figure 21:
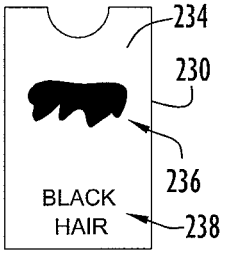

Other embodiments of information cards are illustrated in FIGS. 15-21. As illustrated in FIG. 15, the information card 170 has a reverse side 174 with information indicia 176 and 178, which in this example, relate to the suspect or person having brown eyes. In FIG. 16, the information card 180 has a reverse side 184 with information indicia 186 and 188, which relate to the suspect having glasses. In FIG. 17, the information card 190 includes a reverse side 194 with information indicia 196, which relates to the suspect not having any glasses. In FIG. 18, the information card 200 includes a reverse side 204 with information indicia 206 and 208, which relate to the suspect having a moustache. In FIG. 19, the information card 210 has a reverse side 214 with information indicia 216, which relates to the suspect being clean-shaven. In FIG. 20, the information card 220 has a reverse side 224 with information indicia 226 and 228, which relate to the suspect having blond hair. In FIG. 21, the information card 230 has a reverse side 234 with information indicia 236 and 238, which relate to the suspect having black hair.

Figure 22:
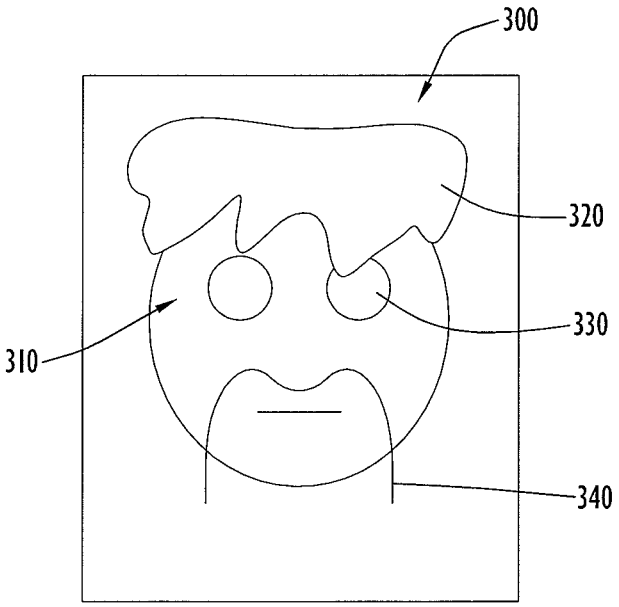
FIG. 22 is an embodiment of a potential solution according to the present invention.

In FIG. 22, one of the kingpins of the solution card illustrated in FIG. 3 is shown. This kingpin 300 includes traits 310, 320, 330, and 340, which correspond to no glasses, blond hair, blue eyes, and moustache, respectively.

Figure 23:
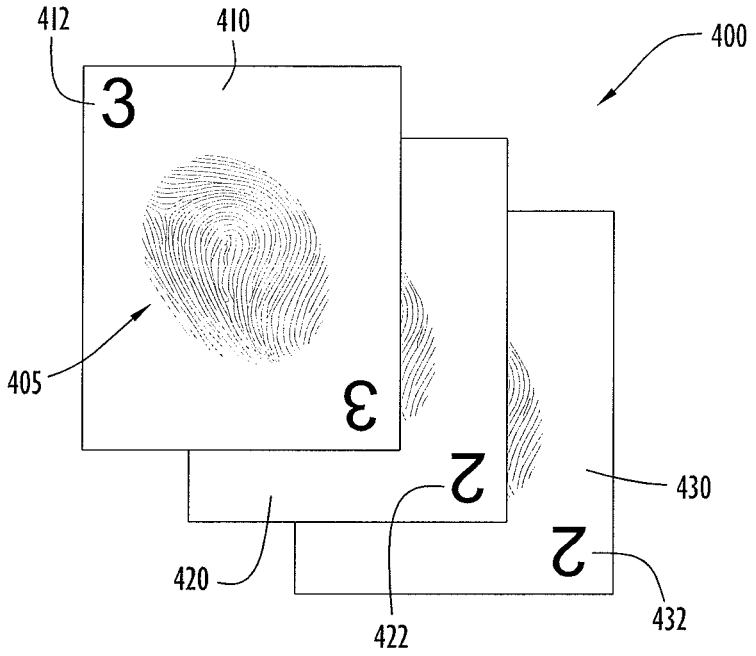
FIG. 23 is a view of an exemplary meld of playing cards according to the present invention.

As previously described, there are several manners in which a meld of playing cards can be formed. In FIG. 23, the exemplary meld of FIG. 1 is illustrated. Meld 400 is formed of three playing cards 410, 420, and 430, which are of the same suit, as indicated by suit indicia 405 (i.e., a finger print). Each playing card includes a card value indicia. In this example, the sum of the card value indicia of the card meld is 7.

Figure 24:
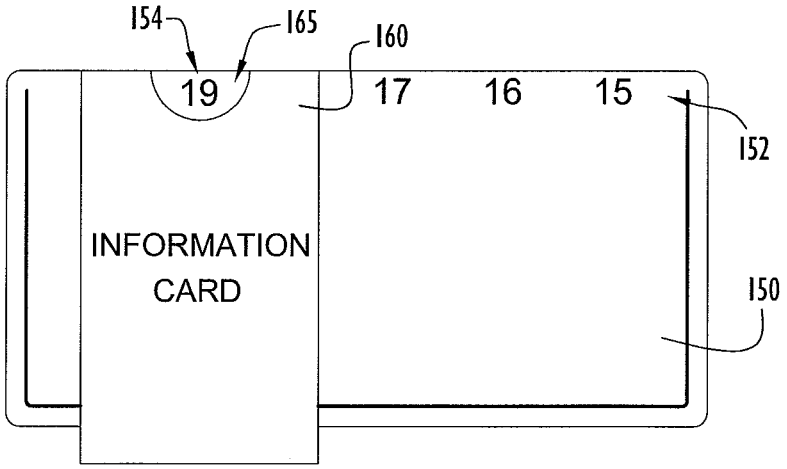
FIG. 24 is a view of an information card associated with a requirement card, according to the present invention.

Referring to FIG. 24, an association of an information card and a requirement card is illustrated (as shown in FIGS. 4-6). Requirement card 150 includes requirement indicia 152. As information card 160 is placed on the requirement card 160, the notch 165 allows a particular one of the requirement indicia 154 to be displayed within the notch 165.

Figure 25:
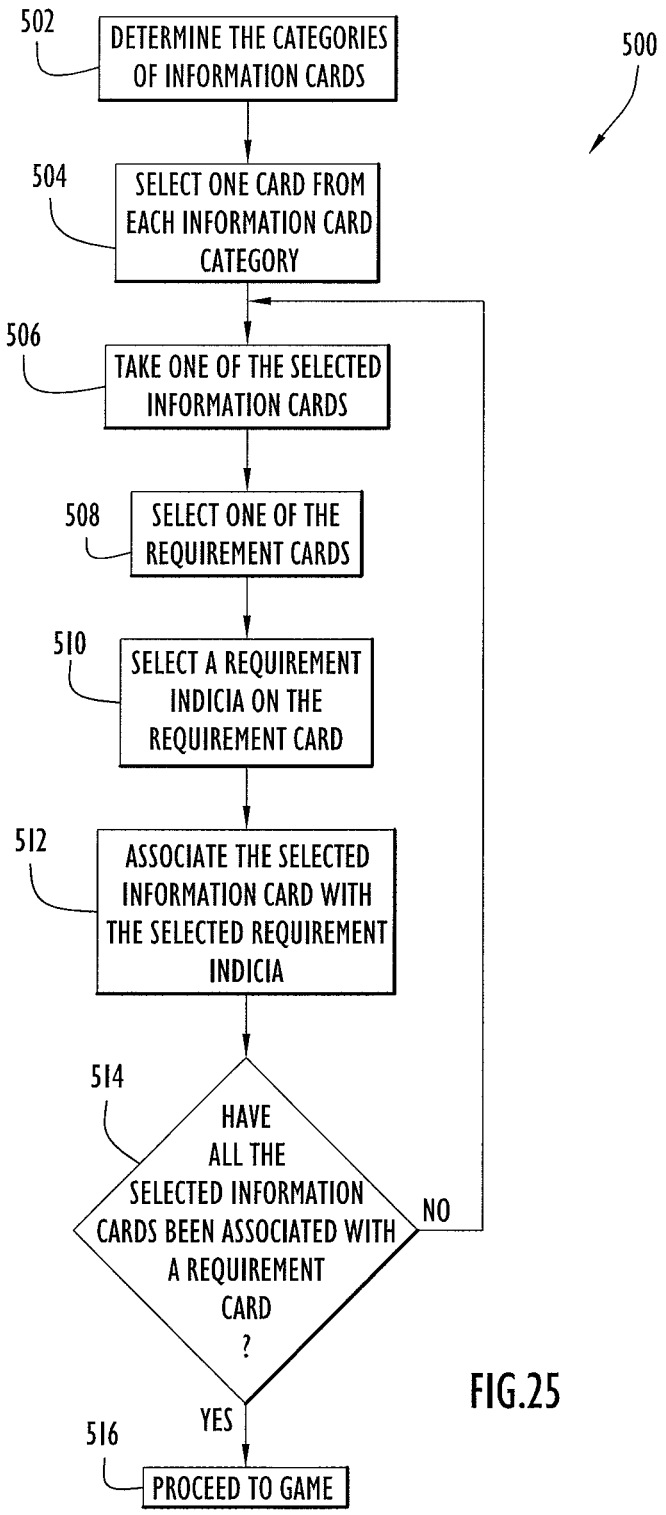
FIG. 25 is a flowchart of an exemplary game set-up process according to the present invention.

Now, several exemplary processes of the present invention will be described. Referring to FIG. 25, an exemplary game set-up process 500 is described. In step 502, one of the players determines the categories of information cards to be used in the game. As previously discussed, the categories can include eye color, hair color, facial hair and glasses.

In step 504, the player selects one card from each of the information card categories. Preferably, the player selects the cards without looking at the reverse side of any of the information cards.

In step 506, the player takes one of the selected information cards.

In step 508 the player takes one of the requirement cards and in step 510, the player selects a requirement indicia on the requirement card.

In step 512, the particular information card is associated with the selected requirement card and in particular, with the selected requirement indicia. An example of such association is illustrated in FIGS. 4-6 and more specifically in FIG. 24 in which the requirement indicia of 19 has been selected and associated with the particular information card 160.

In step 514, the player determines whether all of the initially selected information cards have been associated with a requirement card. If so, then the process continues to step 516 in which the game is played. If not, then the process returns to step 506 and the process of associating the selected information cards with requirement cards is repeated until step 516 is reached.

Figure 26:
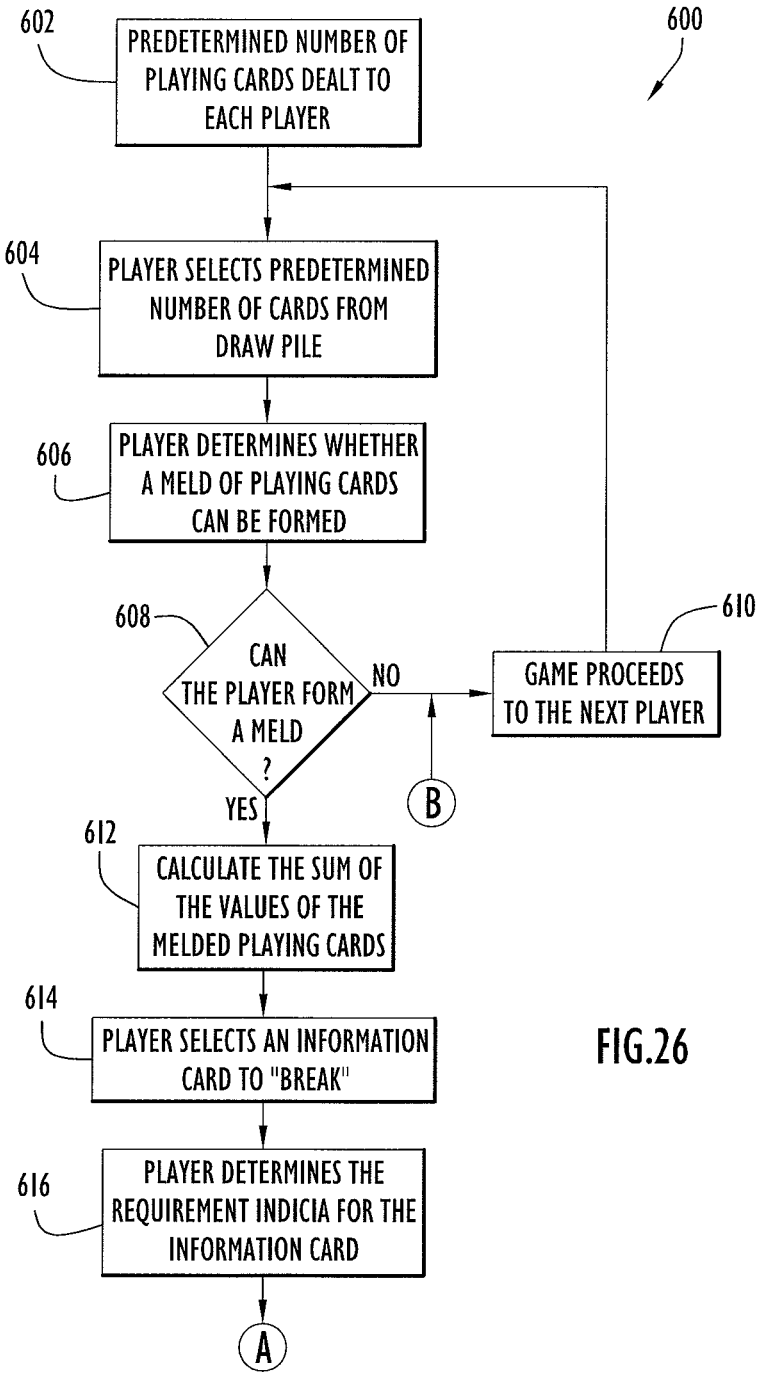
FIGS. 26 and 27 are flowcharts of an exemplary game play process according to the present invention.
Figure 27:
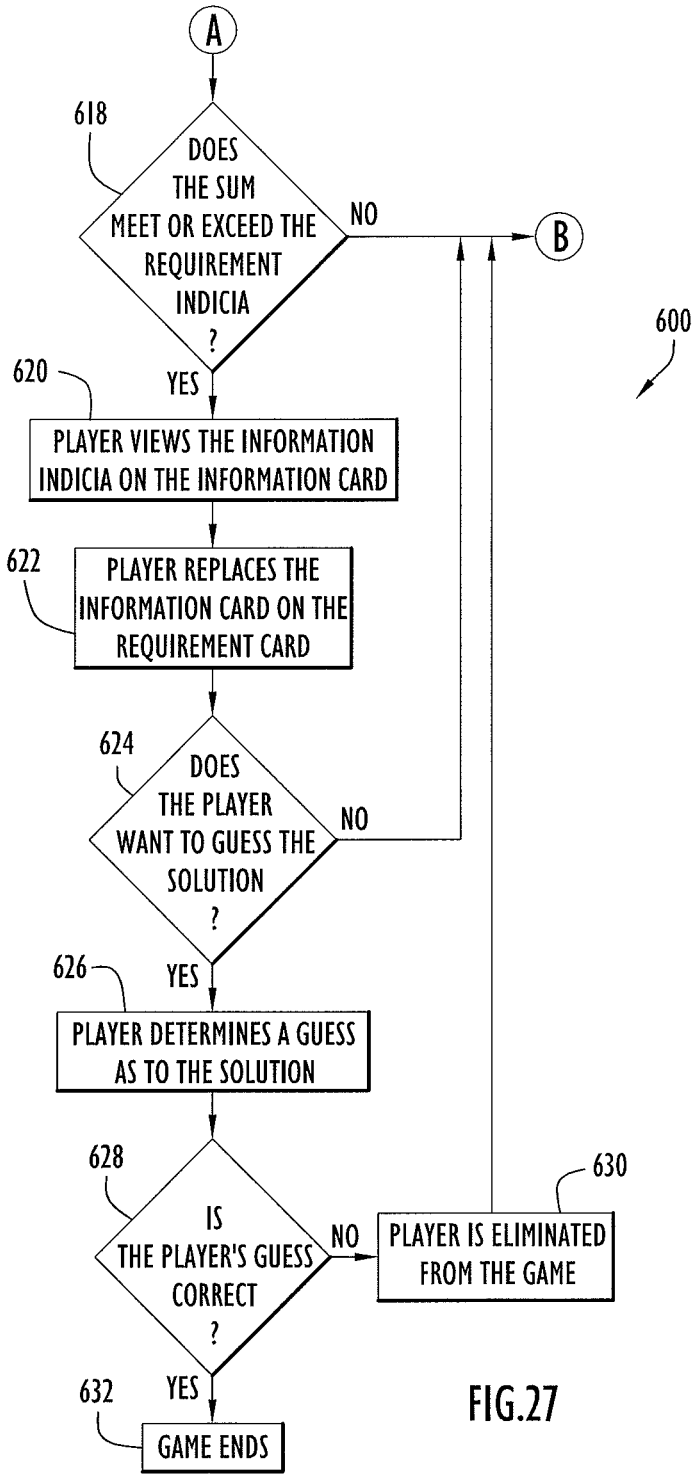

An exemplary embodiment of a game play process in accordance with the present invention is illustrated in FIGS. 26 and 27. In this embodiment, the game play process 600 is merely exemplary and various game play processes may include some and not all of the illustrated steps.

In step 602, a predetermined number of playing cards are dealt to each player in the game.

In step 604, the first player selects a predetermined number of cards from either a draw pile or a discard pile.

In step 606, the player determines whether a meld of playing cards can be formed. As previously discussed, the requirements for a meld in a game can vary and should be established by the players at the start of the game. If the player can form a meld (step 608), then the process continues to step 612. If the player cannot form a meld, then at step 610 the game proceeds to the next player and the process returns to step 604.

In step 612, the player calculates the sum of the values of the melded playing cards. As previously described, the sum can be the addition of the card value indicia on the melded playing cards (without the use of a rolled die).

In step 614, the player selects an information card to "break." Breaking an information card means the player is trying to meet or exceed the requirement indicia associated with the information card.

In step 616, the player determines the particular requirement indicia for the selected information card.

In step 618 (see FIG. 27), the player determines whether the meld sum meets or exceeds the requirement indicia. If the meld sum does not meet or exceed the requirement indicia, then the game proceeds to the next player and the process returns to step 610. If the sum does meet or exceed the requirement indicia, the process continues to step 620.

In step 620, the player views the information indicia on the information card. Preferably, the player does not allow any of the other players to view the information indicia.

In step 622, the player replaces the information card on the requirement card. In this example, the information card is placed on the requirement card with the requirement indicia visible due to the notch in the information card.

In step 624, the player determines whether the player wants to guess the solution to the game. In this embodiment, the solution to the game is the identification of one of the kingpins on the solution card. If the player does not want to make a guess at this time, the game proceeds to the next player and the process returns to step 610. If the player does want to make a guess, then the process continues to step 626.

In step 626, the player determines a guess as to the solution of the game.

In step 628, the player determines whether the guess is correct. This determination can be done by the player viewing the information cards that were initially selected. If the player's guess is incorrect, then the player is eliminated from the game (step 630) and the game proceeds to the next player and the process returns to step 610. In this case, the player that guessed incorrectly no longer can play in the current game. If the player's guess is correct, then the game ends (step 632).

Figure 28:
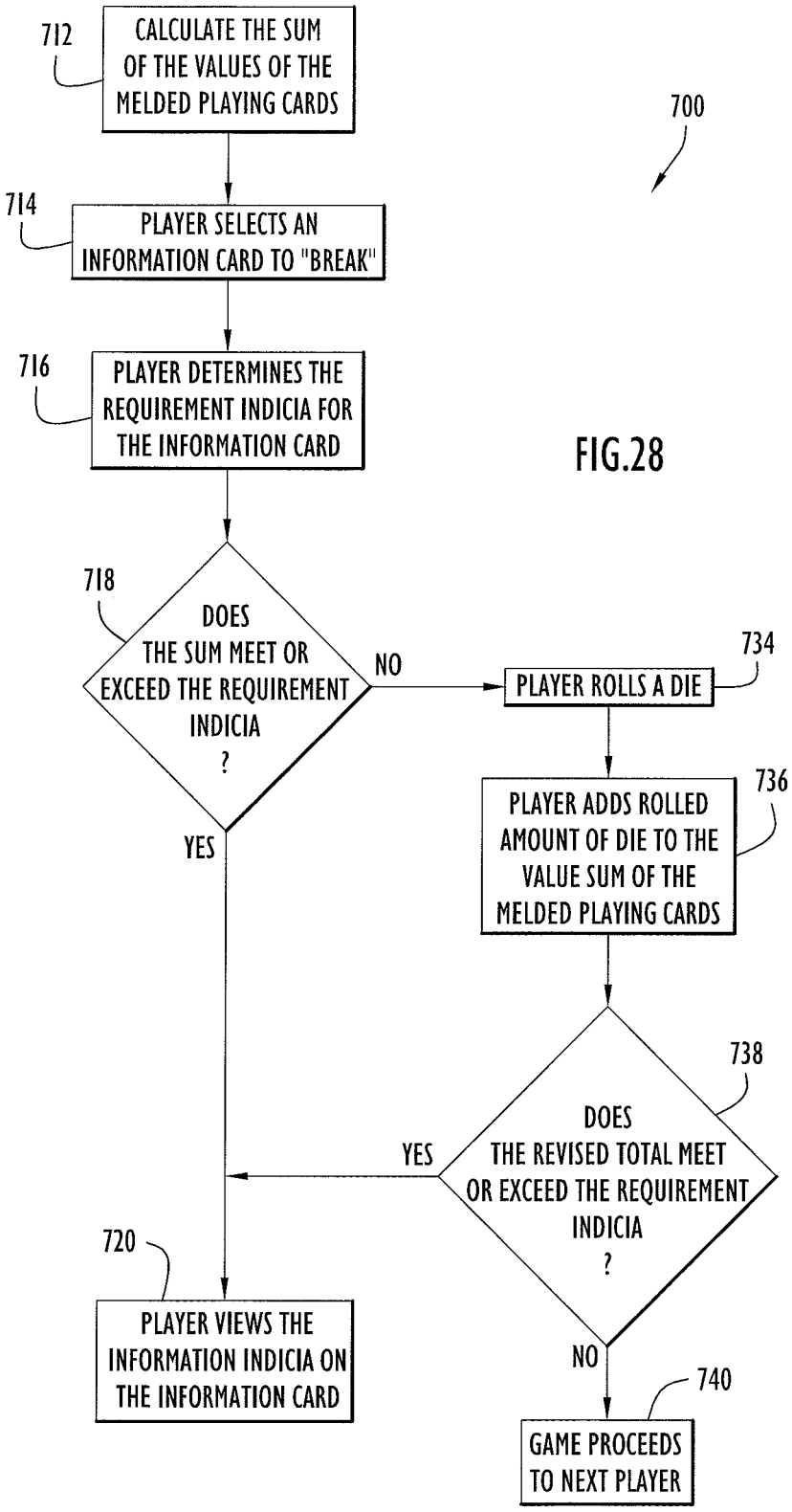
FIG. 28 is a flowchart of a portion of an alternative game play process according to the present invention.

An exemplary embodiment of an alternative portion of a game play process is illustrated in FIG. 28. In this embodiment, the game play process 700 includes several steps that have been previously described with respect to process 600 (FIGS. 26 and 27). In particular, the steps of 712, 714, 716, 718, and 720 correspond to steps 612, 614, 616, 618, and 620 of process 600.

In step 718, the player determines whether the sum meets or exceeds the requirement indicia. If the sum does meet or exceed the requirement indicia, the process continues to step 720. However, if the sum does not meet or exceed the requirement indicia, then the player has the option to roll a die (step 734).

In step 736, the player adds the amount rolled on the die to the value sum of the melded playing cards.

In step 738, the player determines whether the revised total meets or exceeds the requirement indicia. If the revised total is sufficient, then the player views the information indicia on the information card (step 720). If the revised total is insufficient, then the game proceeds to the next player (step 740).

Figure 29:
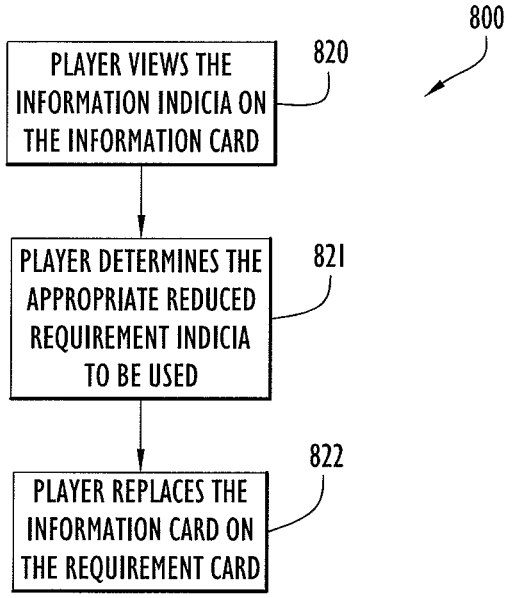
FIG. 29 is a flowchart of another portion of an alternative game play process according to the present invention.

An exemplary embodiment of an alternative portion of a game play process is illustrated in FIG. 29. In this embodiment, the game play process 800 includes several steps that have been previously described with respect to process 600 (FIGS. 26 and 27). In particular, the steps of 820 and 822 correspond to the steps 620 and 622 of process 600.

In step 821, the player determines the appropriate reduced requirement indicia to be used with the replacement of the information card on the requirement card. As previously described, in one game process, once an information card has been viewed, the requirement indicia associated with the information can be reduced. For example, when the information card is placed back on the requirement card in step 822, the particular requirement indicia on the requirement card that is viewable in the notch of the information is lower than before. In one example, if the information card was aligned with the number 19 on the requirement card, then it can be placed on the requirement card with the number 17 showing in the notch.

Several aspects of the exemplary methods of game play may be modified from that disclosed above, and may be reflected in the set of rules to accompany the game. For example, the rules may specify any number of cards to be dealt initially, or drawn and/or discarded during a turn, different options for play available to each player on a turn, a different order of actions or phases during a player's turn, timing rules, and so forth.

Optionally, as mentioned above, the configuration of the game components may be modified to achieve a desired effect, in conjunction with the game rules. The apparatus and/or rules of the game may thus provide game play with a desired degree of complexity or difficulty, for example to adapt the game to players of a predetermined age range, and/or to adjust the relative degrees to which chance and strategy determine the winner of the game.

It is believed that the disclosure set forth above encompasses multiple distinct inventions with independent utility. While each has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such description should be understood to include incorporation of one or more such elements, neither requiring nor excluding two or more such elements.

Inventions embodied in various combinations and subcombinations of features, functions, elements, and/or properties may be claimed through presentation of claims in a related application. Such claims are also regarded as included within the subject matter of the inventions of the present disclosure.

What is claimed is:

1. A method of playing a melding card game, the method comprising:

separating information cards into categories of information cards, each information card including information indicia, each category of information cards including cards with related information indicia;

selecting an information card from each category of information cards;

for each selected information card, selecting a requirement card and a particular requirement indicia thereon and associating the selected information card with the selected requirement card so that the particular requirement indicia is identified;

dealing a predetermined number of playing cards to each player;

beginning a round wherein each player in turn is allowed to:

choose to draw a card from either a remaining deck of playing cards or a discard pile of playing cards, form a meld of playing cards, select an information card and its associated requirement card, determine whether a value of the meld of playing cards meets or exceeds the requirement indicia associated with the information card selected by the player, and view the information card selected by the player if the value of the meld of playing cards meets or exceeds the identified requirement indicia.

2. The method of claim 1, wherein during a turn, a player is allowed to combine the value of a meld of playing cards formed that turn and the value of a meld of playing cards formed in a previous turn, and the player is allowed to view an information card selected by the player if the value of the melds of playing cards meets or exceeds the identified requirement indicia.

3. The method of claim 1, wherein during a turn, a player is allowed to roll a die and to combine the value of a meld of playing cards with the number rolled on the die, and the player is allowed to view an information card selected by the player if the sum of the value of the meld of playing cards and the number rolled by the die meets or exceeds the identified requirement indicia.

4. The method of claim 1, wherein during a turn, after viewing an information card, the player is allowed to replace the information card with its associated requirement card so that a different requirement indicia is identified.

5. The method of claim 4, wherein the different requirement indicia that is identified is lower than the requirement indicia that the player needed to meet or exceed to view the information card.

6. The method of claim 1, wherein the meld of playing cards is a first meld of playing cards, the information card is a first information card, and in a subsequent round, each player in turn is allowed to:

form a second meld of playing cards, select a second information card and its associated requirement card, determine whether a value of the second meld of playing cards meets or exceeds the requirement indicia associated with the second information card selected by the player, and view the second information card selected by the player if the value of the meld of playing cards meets or exceeds the associated requirement indicia for the second information card.

7. The method of claim 1, wherein the game involves the players guessing the identity of a suspect, and during each turn, each player is allowed to determine whether that player wants to guess the identity of the suspect.

8. The method of claim 7, wherein a player that guesses the identity of the suspect incorrectly is eliminated from the game.

9. The method of claim 7, wherein guessing the identity of a suspect includes identifying a suspect from a plurality of suspects on a solution card.

10. The method of claim 1, wherein the associating the selected information card with the selected requirement card includes aligning the selected information with the particular requirement indicia on the selected requirement card.

11. The method of claim 10, wherein each selected information card includes a notch formed therein that can be positioned so that the selected requirement indicia is visible through the notch in the selected information card.

12. A method of playing a melding card game using information cards, at least one requirement card, and playing cards, the method comprising:

separating the information cards into categories of information cards, each information card including information indicia, each category of information cards including cards with related information indicia;

selecting an information card from each category of information cards;

for each selected information card, selecting a requirement card and a particular requirement indicia thereon and associating the selected information card with the selected requirement card so that the particular requirement indicia is identified;

dealing a predetermined number of playing cards to each player; and allowing each player in turn to:

select a playing card, determine whether a meld of playing cards can be formed from the playing cards in that player's possession, and if a meld of playing cards can be formed in that turn, calculate the value of the melded playing cards, select an information card and its associated requirement card, determine whether the value of the meld of playing cards meets or exceeds the requirement indicia associated with the information card selected by the player, view the information card selected by the player if the value of the meld of playing cards meets or exceeds the identified requirement indicia, and guess the identity of a suspect.

13. The method of claim 12, wherein during a turn, a player is allowed to combine the value of a meld of playing cards formed that turn and the value of a meld of playing cards formed in a previous turn, and the player is allowed to view an information card selected by the player if the value of the melds of playing cards meets or exceeds the identified requirement indicia.

14. The method of claim 12, wherein during a turn, a player is allowed to roll a die and to combine the value of a meld of playing cards with the number rolled on the die, and the player is allowed to view an information card selected by the player if the sum of the value of the meld of playing cards and the number rolled by the die meets or exceeds the identified requirement indicia.

15. The method of claim 12, wherein during a turn, after viewing an information card, the player is allowed to replace the information card with its associated requirement card so that a different requirement indicia is identified.

16. A method of playing a melding card game involving the guessing of an identity of a suspect, the card game including information cards, requirement cards, and playing cards, each of the information cards being assigned to a different category and having indicia relating to its assigned category, each of the requirement cards having requirement indicia thereon, the method comprising:

selecting an information card from each category of information cards and associating the selected information card with requirement indicia on one of the requirement cards;

allowing each player in turn to:

select a playing card, determine whether a meld of playing cards can be formed from the playing cards in that player's possession, if a meld of playing cards can be formed in that turn, calculate the sum of the values of the melded playing cards, select an information card and identify its associated requirement indicia, determine whether the calculated sum meets or exceeds the requirement indicia associated with the selected information card, and view the information card selected by the player if the calculated sum meets or exceeds the identified requirement indicia.

17. The method of claim 16, wherein each player is allowed to guess the identity of the suspect.

18. The method of claim 16, wherein during a turn, a player is allowed to combine the value of a meld of playing cards formed that turn and the value of a meld of playing cards formed in a previous turn, and the player is allowed to view an information card selected by the player if the sum of the values of the melds of playing cards meets or exceeds the identified requirement indicia.

19. The method of claim 16, wherein during a turn, after viewing an information card, the player is allowed to replace the information card with its associated requirement card so that different requirement indicia is identified with the replaced information card.

20. The method of claim 16, wherein the meld of playing cards is a first meld of playing cards, the information card is a first information card, and in a subsequent round, each player in turn is allowed to:

form a second meld of playing cards, select a second information card and its associated requirement card, determine whether a value of the second meld of playing cards meets or exceeds the requirement indicia associated with the second information card selected by the player, and view the second information card selected by the player if the value of the meld of playing cards meets or exceeds the associated requirement indicia for the second information card.

* * * * *